US008951104B2

(12) United States Patent
Liang et al.

(10) Patent No.: US 8,951,104 B2
(45) Date of Patent: Feb. 10, 2015

(54) FIXING STRUCTURE FOR VENTILATOR COVER SPRING

(75) Inventors: Qiuqian Liang, Guangdong (CN); Haiying Xu, Guangdong (CN)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 1396 days.

(21) Appl. No.: 12/665,061

(22) PCT Filed: May 9, 2008

(86) PCT No.: PCT/CN2008/000921

§ 371 (c)(1),
(2), (4) Date: Dec. 17, 2009

(87) PCT Pub. No.: WO2009/000142

PCT Pub. Date: Dec. 31, 2008

(65) Prior Publication Data

US 2010/0167638 A1 Jul. 1, 2010

(30) Foreign Application Priority Data

Jun. 27, 2007 (CN) ..... 2007 1 0109517

(51) Int. Cl.

| | |
|---|---|
| ***F04D 29/60*** | (2006.01) |
| ***F04D 25/12*** | (2006.01) |
| ***F04D 29/62*** | (2006.01) |
| ***F04D 29/64*** | (2006.01) |
| ***F04D 29/70*** | (2006.01) |
| *F24F 13/00* | (2006.01) |

(52) U.S. Cl.

CPC ..... *F04D 25/12* (2013.01); *F04D 29/626* (2013.01); *F04D 29/646* (2013.01); *F04D 29/703* (2013.01)

USPC ..... 454/367

(58) Field of Classification Search

USPC ..... 454/254, 275, 284, 292, 367

See application file for complete search history.

(56) References Cited

FOREIGN PATENT DOCUMENTS

| | | | | |
|---|---|---|---|---|
| CN | 101210579 A | * | 7/2008 | |
| JP | 05346255 A | * | 12/1993 | |
| JP | 07190453 A | * | 7/1995 | ..... F24F 7/10 |
| JP | 7190453 A | * | 7/1995 | |

(Continued)

OTHER PUBLICATIONS

Tsukitari, JP07190453 A English machine translation, Jul. 28, 1995.*

(Continued)

*Primary Examiner* — Kang Hu
*Assistant Examiner* — Phillip E Decker
(74) *Attorney, Agent, or Firm* — RatnerPrestia

(57) ABSTRACT

Disclosed is a fixing structure for ventilator cover spring, comprising a fixing component, a connector, a movable part, and a cover spring. The fixing component is a U-shaped protrusion formed on a cover and has a top wall and two leg walls, a first opening and a second opening are respectively formed in the two leg walls. Two cuts are formed at two ends of the connector, wherein each cut is provided with a tongue, the connector being inserted through and fixed in the first opening and the second opening. The movable part has a head portion and a foot portion, wherein the head portion is fixed on the connector, and the foot portion extends toward the top wall. The cover spring is fitted over the foot portion and is confined on the foot portion.

13 Claims, 9 Drawing Sheets

(56) References Cited

FOREIGN PATENT DOCUMENTS

| | | | | | |
|---|---|---|---|---|---|
| JP | 07217961 | A * | 8/1995 | ..... | F24F 7/10 |
| WO | WO 2008090724 | A1 * | 7/2008 | ..... | F24F 13/20 |

OTHER PUBLICATIONS

Hirano, WO 2008/090724 A1 English machine translation, Jul. 31, 2008.*

* cited by examiner

FIXING STRUCTURE FOR VENTILATOR COVER SPRING

FIELD OF THE INVENTION

The present invention relates to a ventilator, and more particularly, to a fixing structure for mounting a ventilator cover spring.

BACKGROUND OF THE INVENTION

Ventilators are common air circulating devices for exhausting the indoor air. FIG. 1 is a schematic view of a ventilator 100. As shown in FIG. 1, cover 10 covers a machine body 11. FIG. 1 shows the front side of the cover 10. FIG. 2 is a schematic view of the mounting side of the cover 10 where the cover 10 is mounted onto the body 11. A screw 12 is screwed into the iron block 14 for securing a spring 13 with the cover 10. The screw 12 is drilled directly into the cover 10.

When the cover 10 is made of a PBT material, residual stress may be generated during the shaping of the cover 10 due to the characteristic of the PBT. In that case, if the screw 12 having permeable chemical substance stuck thereon is directly screwed into the cover 10, cracks or breakage may occur in the cover 10 made of PBT material and therefore the cover 10 may not be stably mounted and there is a risk that the cover might drop from the body 11.

Therefore, it is desirable to provide a stable and reliable fixing structure for mounting the spring of the ventilator cover.

SUMMARY OF THE INVENTION

A main object of the present invention is to provide a fixing structure for ventilator cover spring, which has higher stability.

Another object of the present invention is to provide a fixing structure for ventilator cover spring, which enables good mounting performance.

In order to achieve at least one of the above objects, the present invention provides a fixing structure for mounting a ventilator cover spring, comprising: a fixing component, the fixing component being a U-shaped protrusion formed on a cover and having a top wall and two leg walls, a first opening and a second opening being respectively formed in the two leg walls; a connector, two cuts being formed at two ends of the connector, each cut being provided with a tongue, the connector being inserted through and fixed in the first opening and the second opening; a movable part, the movable part having a head portion and a foot portion, the head portion being fixed on the connector, the foot portion extending toward the top wall; and a cover spring, the cover spring being fitted over the foot portion and being confined on the foot portion.

A projection is provided at an end of the foot portion of the movable part for restricting the cover spring from dropping off the foot portion.

The foot portion of the movable part is firstly bent and then extended to abut against the top wall.

The head portion of the movable part is bent to abut against the connector.

The head portion of the movable part is bent to surround the connector.

A third opening is formed in one of the leg walls of the fixing component, and the head portion of the movable part has an extended part to be inserted through the third opening.

A fourth opening is formed in the top wall of the fixing component, and the foot portion of the movable part is inserted through the fourth opening.

An end of the foot portion of the movable part is hooked on an outside of the fourth opening.

The fixing component is provided with reinforcing ribs on the periphery thereof.

The connector and the movable part are made of metal material, and the connector and the movable part are connected and secured by a screw.

The present invention is advantageous in that because the connector or the movable part is not directly mounted on the fixing component via a screw, there is no stress generated on the fixing component and thus the cover can not be damaged. That is, the cover is unlikely drop, thus the reliability of the product is improved.

DETAILED DESCRIPTION OF THE PREFERRED EMBODIMENTS

Figure 1:
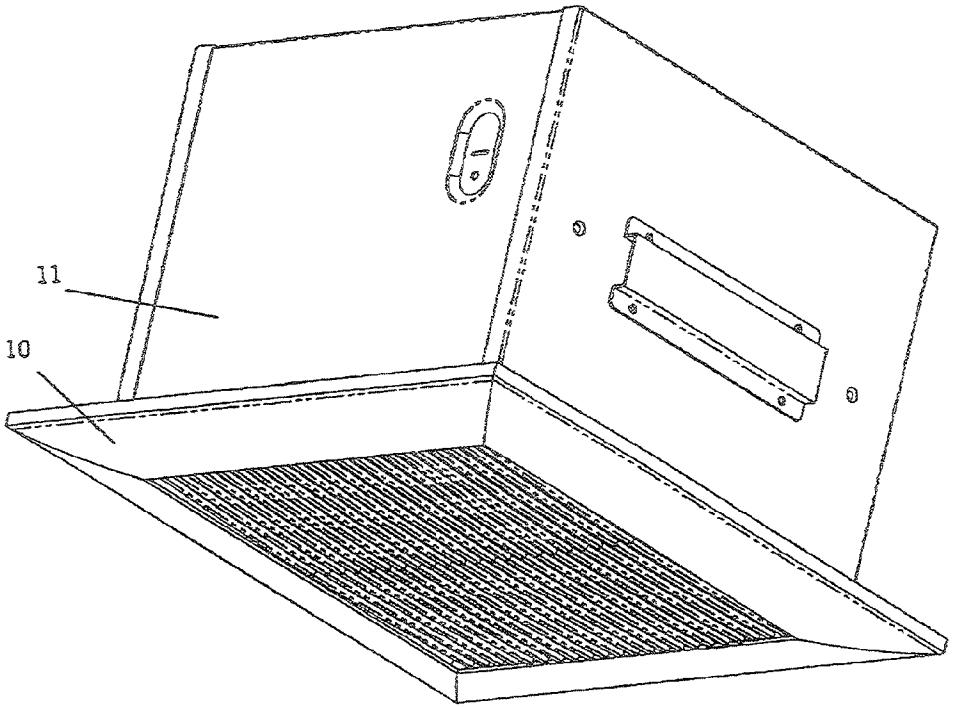
Fig. 1 (Prior Art)
FIGS. 1 and 2 are schematic view of the prior art.
Figure 2:
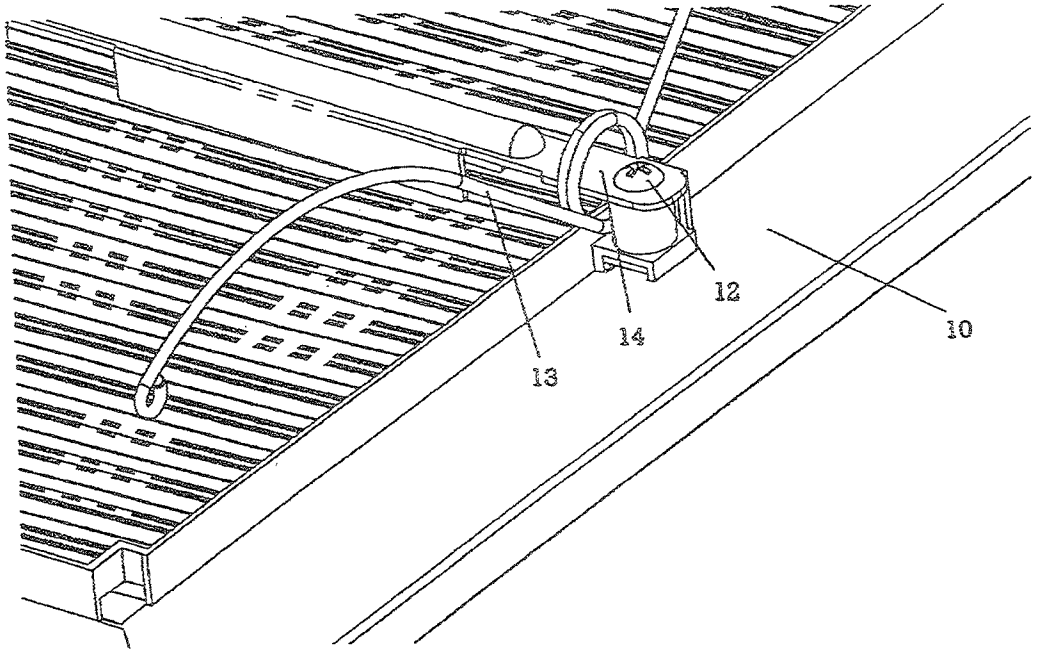
Fig. 2 (Prior Art)

The present invention will be described in detail with reference to the embodiments. The examples thereof are shown in the figures. Throughout the drawings, the same reference numerals designate the same elements or parts. The embodiment is described in conjunction with the drawings in order to explain the present invention.

Figure 3:
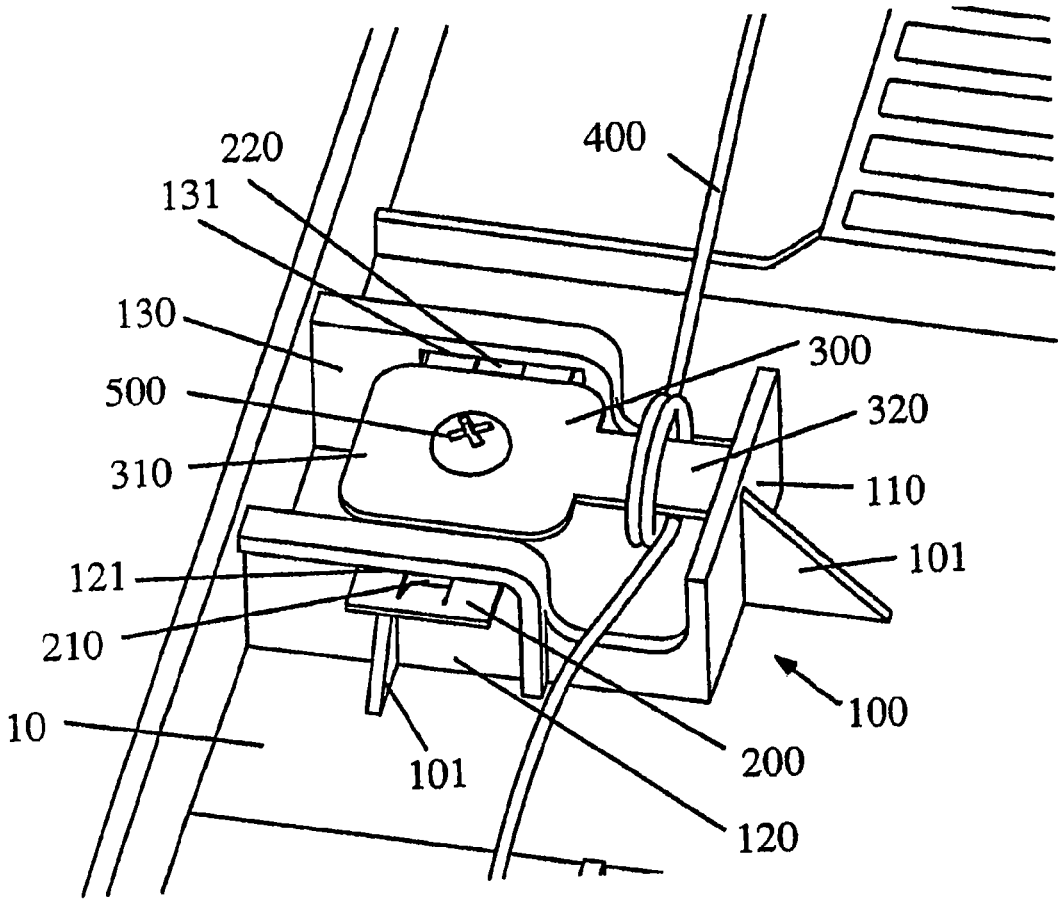
FIG. 3 is a schematic view of the first embodiment of the present invention.

FIG. 3 shows the first embodiment of the present invention. A fixing component 100 is a transverse U-shaped protrusion formed on a cover 10. The fixing component 100 has a top wall 110 and two leg walls 120, 130. A first opening 121 and a second opening 131 are respectively formed in the two leg walls 120, 130. Reinforcing ribs 101 are provided on the periphery of the top wall 110 and the two leg walls 120 and 130 for reinforcing rigidity thereof.

A connector 200 is inserted through the first opening 121 and the second opening 131. Two cuts 210 and 220 are formed at two ends of the connector 200. Each cut is provided with a tongue.

A movable part 300 has a head portion 310 and a foot portion 320. The head portion 310 is fixed on the connector 200. The foot portion 320 is extended toward the top wall 110. A cover spring 400 is fitted over the foot portion 320 and confined on the foot portion 320.

According to an embodiment of the present invention, the connector 200 and the movable part 300 are both made of metal material. Screw holes are formed in the middle of the connector 200 and the head portion 310 of the movable part, respectively.

Upon mounting, firstly, the connector 200 is inserted through the first opening 121 and the second opening 131 of the fixing component 100 in turn. Since the connector 200 has two cuts 210 and 220 formed at two ends thereof and the width between the two cuts 210 and 220 is just equal to the width between the two leg walls 120 and 130, the connector 200 can be well lodged on the fixing component 100. Then, the cover spring 400 is fitted over the foot portion 320 of the movable part 300. Finally, the head portion 310 of the movable part 300 is secured on the connector 200 by a screw 500 so that the foot portion 320 of the movable part 300 is extended toward the top wall 110 of the fixing component 100 with the length of the foot portion 320 being equal to or slightly smaller than the distance between the connector 200 and the top wall 110. In other words, there is no gap or there is a small gap between the tip of the foot portion 320 and the top wall 110, so that the cover spring 400 can be prevented from dropping off from the tip of the foot portion 320.

As shown in this embodiment, there is no screw which is used in the cover 10 or the fixing component 100. Therefore, cracks and breakage can be effectively prevented from occurring in the cover 10 of PBT material.

Figure 4:
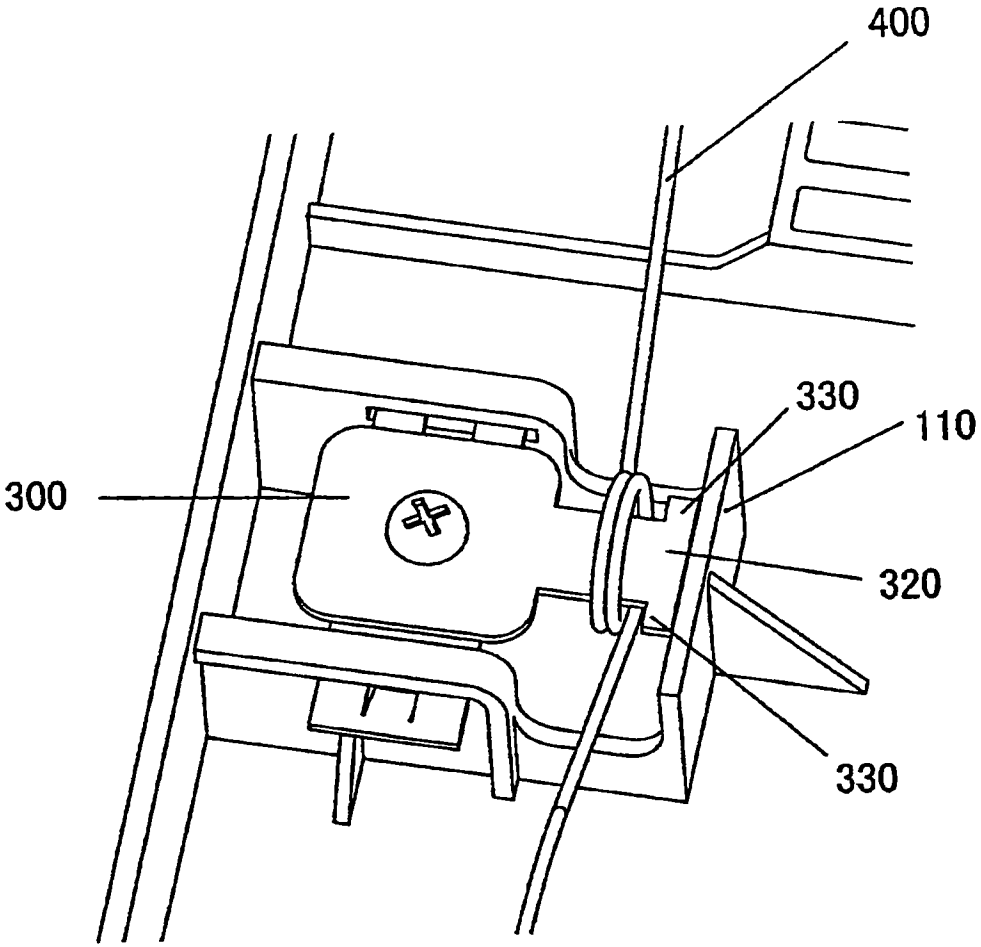
FIG. 4 is a schematic view of the second embodiment of the present invention.

Referring to FIG. 4, it shows a schematic view of the second embodiment of the present invention. The second embodiment differs from the first embodiment in that a projection 330 is provided at an end of the foot portion 320 of the movable part 300 for restricting the cover spring 400 from escaping from the tip of the foot portion 320, even though the gap between the tip of the foot portion 320 and the top wall 110 is greater than the width of the cover spring 400.

Figure 5:
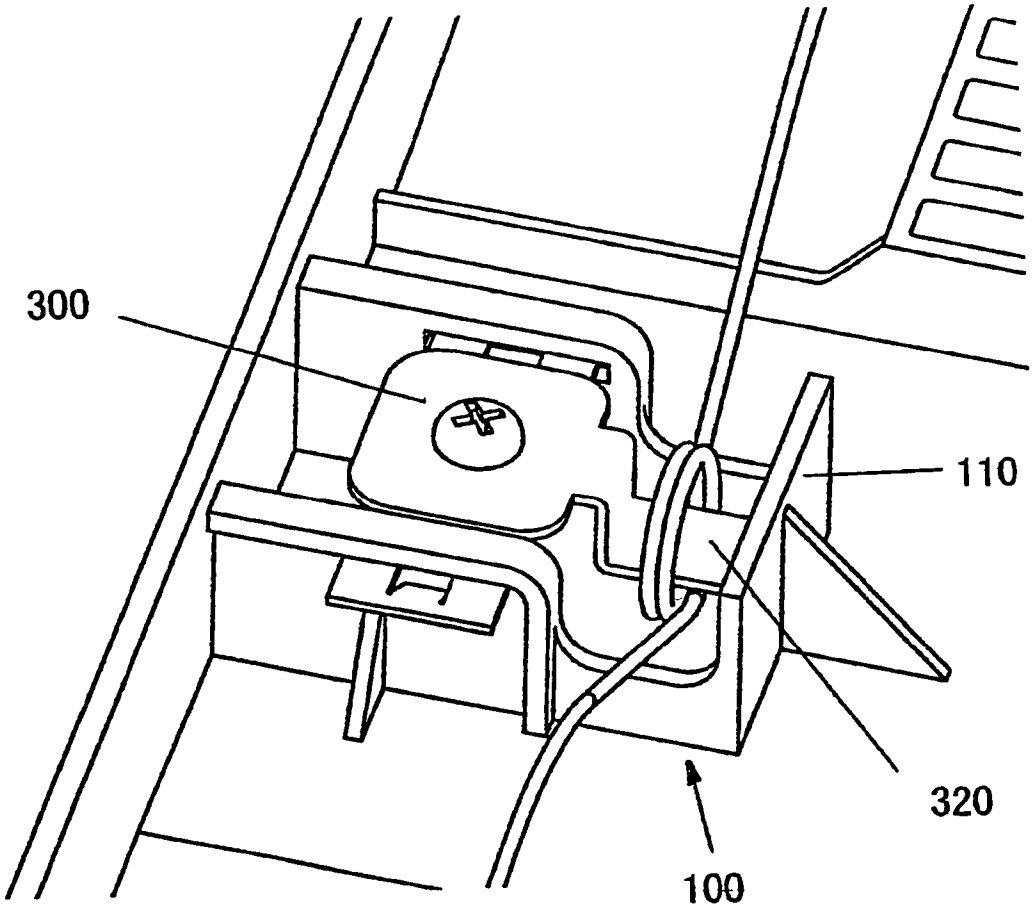
FIG. 5 is a schematic view of the third embodiment of the present invention.

Referring to FIG. 5, it shows a schematic view of the third embodiment of the present invention. The third embodiment differs from the first embodiment in that the foot portion 320 of the movable part 300 is firstly bent and then extended to abut against the top wall 110 of the fixing component 100. The foot portion 320 is bent to form a bending configuration which serves to reinforce the strength of the component.

Figure 6:
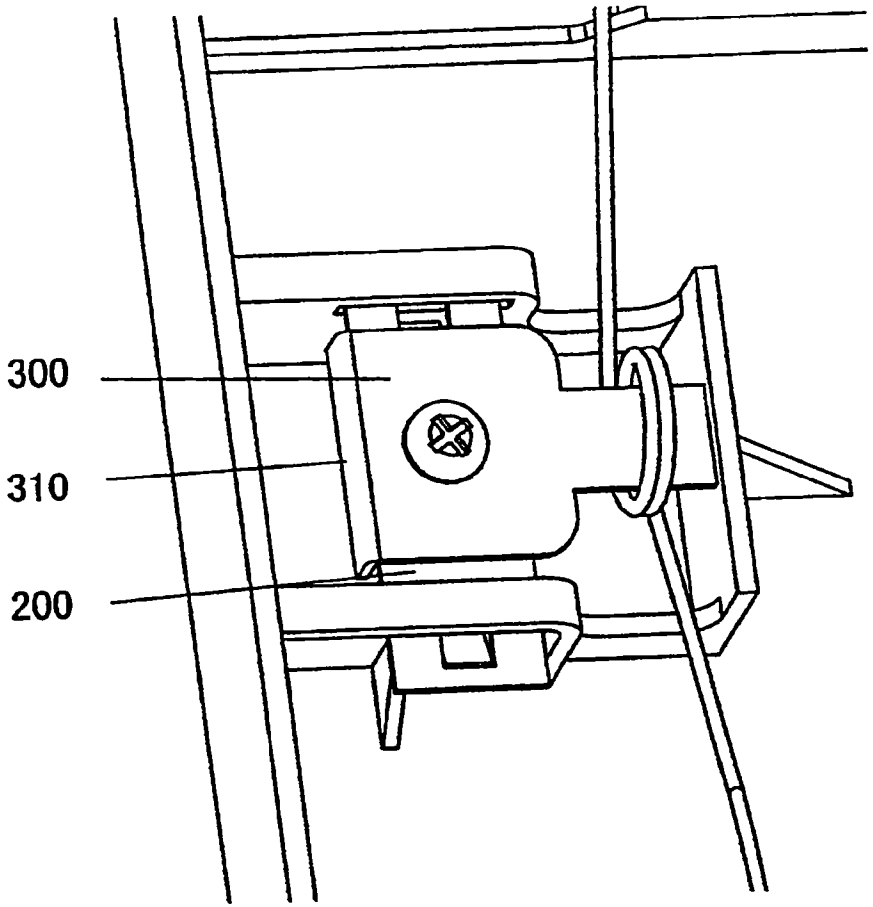
FIG. 6 is a schematic view of the fourth embodiment of the present invention.

Referring to FIG. 6, it shows a schematic view of the fourth embodiment of the present invention. The fourth embodiment differs from the first embodiment in that the head portion 310 of the movable part 300 is bent to abut against the connector 200. In this way, upon mounting, if only the bending part of the head portion 310 abuts against the connector 200, the screw holes of the two components will naturally align with each other. Therefore, it is convenient for mounting operation and the assembling efficiency is improved.

Figure 7A:
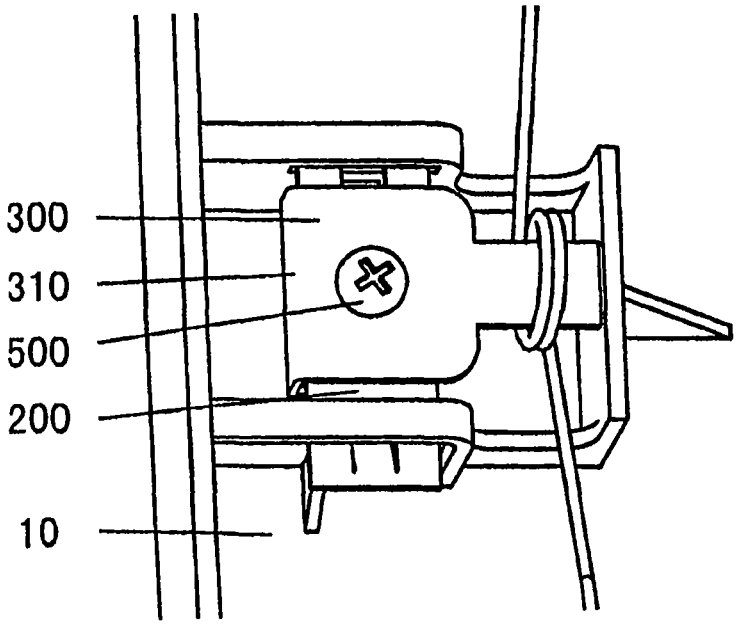
FIGS. 7A and 7B are schematic views of the five embodiment of the present invention.
Figure 7B:
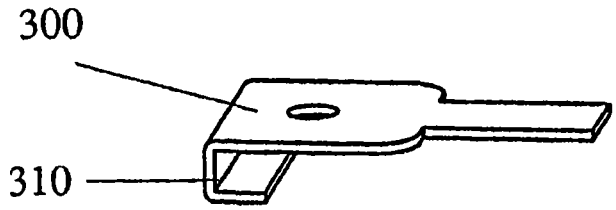

Referring to FIG. 7A, it shows a general schematic view of the fifth embodiment of the present invention. FIG. 7B is a schematic view of the movable part 300. The fifth embodiment differs from the fourth embodiment in that the head portion 310 of the movable part 300 is bent to surround the connector 200. This structure is advantageous in that even if the screw 500 is loosened, the movable part 300 will not drop out of the connector 200. Therefore, the cover spring 400 can be prevented from dropping off the cover 10.

Figure 8:
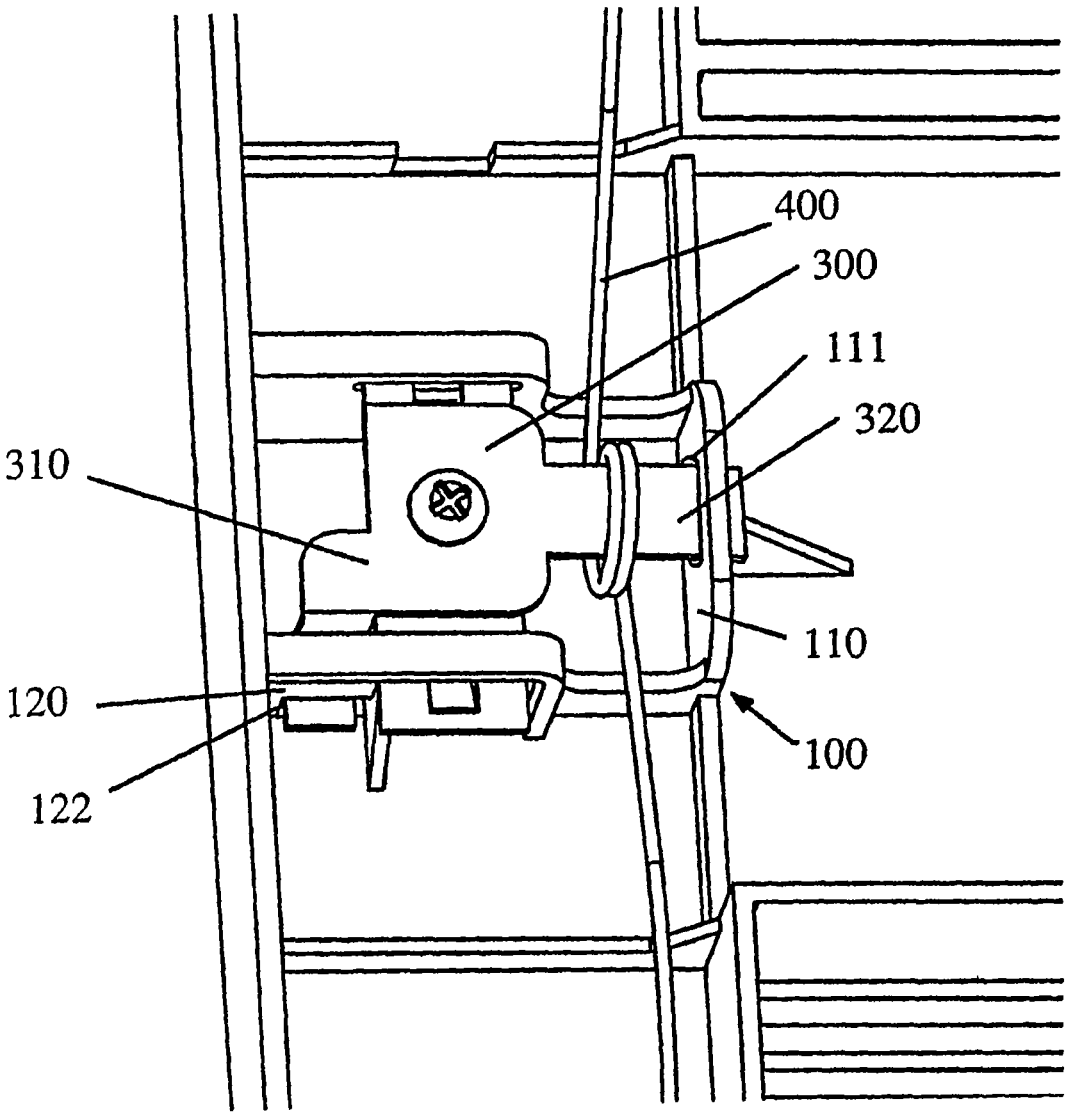
FIG. 8 is a schematic view of the sixth embodiment of the present invention.

Referring to FIG. 8, it shows a schematic view of the sixth embodiment of the present invention. The sixth embodiment differs from the first embodiment in that a third opening 122 is formed in a leg wall 120 of the fixing component 100, and the head portion 310 of the movable part 300 has an extended part to be inserted through the third opening 122. Further, a fourth opening 111 is formed in the top wall 110 of the fixing component 100, and the foot portion 320 of the movable part 300 is inserted through the fourth opening 111. The third opening 122 and the fourth opening 111 serve to temporarily fix the fixing component upon mounting so as to facilitate the mounting of the screw and dually fix the movable part 300. At the same time, the cover spring 400 will not drop off from the tip of the foot portion 320. Therefore, the assembling efficiency is improved and the reliability of the product is ensured.

Figure 9A:
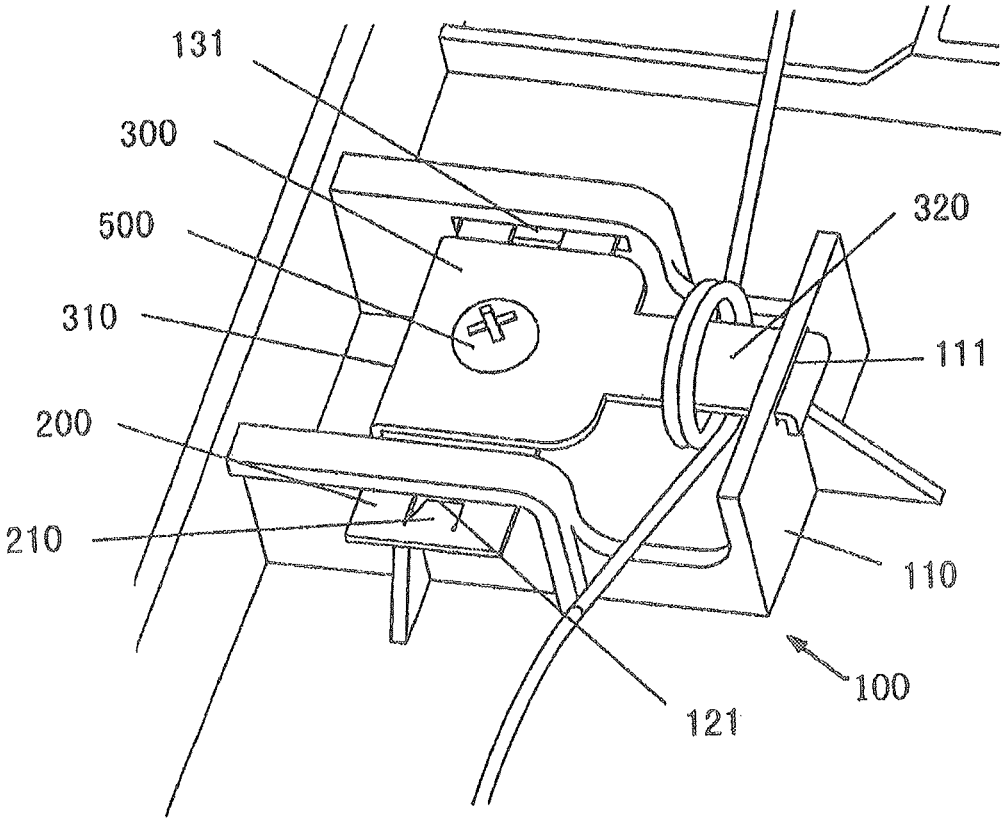
FIGS. 9A and 9B are schematic views of the seventh embodiment of the present invention.
Figure 9B:
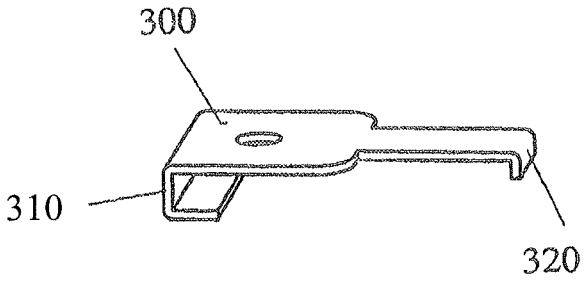

Referring to FIG. 9A, it shows a general schematic view of the seventh embodiment of the present invention. FIG. 9B is a schematic view of the movable part 300. The seventh embodiment differs from the fifth embodiment in that a fourth opening 111 is further formed in the top wall 110 of the fixing component 100, and the end of the foot portion 320 of the movable part 300 is bent and can be inserted through the fourth opening 111 and hooked on the outside of the fourth opening 111. Further, the head portion 310 of the movable part 300 is bent to a larger degree to allow the passage of the connector 200 with cuts 210 and 220 provided with tongues. Upon mounting, firstly, the foot portion 320 of the movable part 300 is inserted through the fourth opening 111. The bending part of the foot portion 320 is hooked on the outside of the fourth opening 111. Then the connector 200 is passed through the first opening 121, the bending part of the movable part 300 and the second opening 131 in turn. Because the head portion 310 and the foot portion 320 have been secured or lodged respectively in advance, the movable part 300 can be fixed on the connector 200 without any screws. However, if the screw 500 is used, the fixation can be ensured.

In the embodiments, the connector 200 and the movable part 300 may be of other materials. The connection between the connector 200 and the movable part 300 may be realized in other ways other than screw connection. These ways are common techniques and will not be listed here.

Although the embodiments of the present invention have been described and illustrated above, it will be appreciated by those skilled in the art that the embodiments can be further modified and changed in various ways without departing from the scope of the claims.

What is claimed is:

1. A fixing structure for a ventilator cover spring, comprising:

a fixing component, the fixing component being a U-shaped protrusion formed on a cover and having a top wall and two leg walls, a first opening and a second opening being formed in the two leg walls respectively;

a connector comprising two ends, at least one of the two ends having a cut formed therein, said cut being provided with a tongue, the connector being inserted through and fixed in the first opening and the second opening:

a movable part, the movable part having a head portion and a foot portion, the head portion being fixed on the connector, the foot portion extending toward the top wall; and a cover spring, the cover spring being fitted over the foot portion and being confined on the foot portion, wherein a third opening is formed in one of the leg walls of the fixing component, and the head portion of the movable part has an extended part to be inserted through the third opening.

2. The fixing structure for a ventilator cover spring according to claim 1, wherein a projection is provided at an end of the foot portion of the movable part for restricting the cover spring from dropping off the foot portion.

3. The fixing structure for a ventilator cover spring according to claim 1, wherein the foot portion of the movable part is firstly bent and then extended to abut against the top wall.

4. The fixing structure for a ventilator cover spring according to claim 1, wherein the head portion of the movable part is bent to abut against the connector.

5. The fixing structure for a ventilator cover spring according to claim 4, wherein the head portion of the movable part is bent to surround the connector.

6. The fixing structure for a ventilator cover spring according to claim 1, wherein the fixing component is provided with reinforcing ribs on the periphery thereof.

7. The fixing structure for a ventilator cover spring according to claim 1, wherein the connector and the movable part are made of metal material, and the connector and the movable part are connected and secured by a screw.

8. The fixing structure for a ventilator cover spring according to claim 1, wherein the movable part is separate from the connector.

9. A fixing structure for a ventilator cover spring, comprising:

a fixing component, the fixing component being a U-shaped protrusion formed on a cover and having a top wall and two leg walls, a first opening and a second opening being formed in the two leg walls respectively;

a connector, two cuts being formed at two ends of the connector, each cut being provided with a tongue, the connector being inserted through and fixed in the first opening and the second opening:

a movable part, the movable part having a head portion and a foot portion, the head portion being fixed on the connector, the foot portion extending toward the top wall; and a cover spring, the cover spring being fitted over the foot portion and being confined on the foot portion, wherein a third opening is formed in one of the leg walls of the fixing component, and the head portion of the movable part has an extended part to be inserted through the third opening.

10. A fixing structure for a ventilator cover spring, comprising:

a fixing component, the fixing component being a U-shaped protrusion formed on a cover and having a top wall and two leg walls, a first opening and a second opening being formed in the two leg walls respectively;

a connector, two cuts being formed at two ends of the connector, each cut being provided with a tongue, the connector being inserted through and fixed in the first opening and the second opening:

a movable part, the movable part having a head portion and a foot portion, the head portion being fixed on the connector, the foot portion extending toward the top wall; and a cover spring, the cover spring being fitted over the foot portion and being confined on the foot portion, wherein a fourth opening is formed in the top wall of the fixing component, and the foot portion of the movable part is inserted through the fourth opening.

11. The fixing structure for a ventilator cover spring according to claim 10, wherein an end of the foot portion of the movable part is hooked on the outside of the fourth opening.

12. A fixing structure for a ventilator cover spring, comprising:

a fixing component, the fixing component being a U-shaped protrusion formed on a cover and having a top wall and two leg walls a first opening and a second opening being formed in the two leg walls respectively;

a connector comprising two ends, at least one of the two ends having a cut formed therein, said cut being provided with a tongue, the connector being inserted through and fixed in the first opening and the second opening:

a movable part, the movable part having a head portion and a foot portion, the head portion being fixed on the connector, the foot portion extending toward the top wall; and a cover spring, the cover spring being fitted over the foot portion and being confined on the foot portion, wherein a fourth opening is formed in the top wall of the fixing component, and the foot portion of the movable part is inserted through the fourth opening.

13. The fixing structure for a ventilator cover spring according to claim 12, wherein an end of the foot portion of the movable part is hooked on the outside of the fourth opening.

* * * * *